US005168982A

United States Patent [19]

Hakanen et al.

[11] Patent Number: 5,168,982

[45] Date of Patent: Dec. 8, 1992

[54] SWITCH DEVICE

[75] Inventors: Pekka Hakanen, Turku; Ari Léman, Pertteli, both of Finland

[73] Assignee: Nokia Mobile Phones Ltd., Salo, Finland

[21] Appl. No.: 687,595

[22] Filed: Apr. 12, 1991

[30] Foreign Application Priority Data

Apr. 12, 1990 [FI] Finland ..... 901893

[51] Int. Cl.[5] ..... H01H 3/48

[52] U.S. Cl. ..... 200/342; 379/424; 200/330; 200/332.1; 200/341

[58] Field of Search ..... 200/329, 330, 332.1, 200/341, 345, 61.76, 61.81, 61.82, 517, 331, 290, 342, 61.41, 61.4; 379/422, 423, 424, 425, 426, 427

[56] References Cited

U.S. PATENT DOCUMENTS

| | | | |
|---|---|---|---|
| 3,229,062 | 1/1966 | Sharples et al. | 200/447 |
| 3,239,641 | 3/1966 | Pettit | 200/330 |
| 3,403,237 | 9/1968 | Wysong | 200/339 X |
| 3,594,529 | 7/1971 | Cartwright | 200/330 |
| 3,668,356 | 6/1972 | Kekas | 200/345 X |
| 3,718,785 | 2/1973 | Kudritzki | 200/61.41 |
| 3,829,632 | 8/1974 | Klehm | 200/517 |
| 4,638,126 | 1/1987 | Breu et al. | 379/425 X |
| 4,668,843 | 5/1987 | Watanabe et al. | 200/517 |
| 4,700,383 | 10/1987 | Takagi et al. | 379/422 X |
| 4,965,420 | 10/1990 | Phillips et al. | 200/342 X |

FOREIGN PATENT DOCUMENTS

| | | | |
|---|---|---|---|
| 1162909 | 2/1964 | Fed. Rep. of Germany | 200/342 |
| 3026971 | 2/1982 | Fed. Rep. of Germany | 200/341 |
| 3032557 | 3/1982 | Fed. Rep. of Germany . | |
| 3340575 | 5/1984 | Fed. Rep. of Germany . | |
| 1201711 | 7/1959 | France | 200/345 |
| 1397900 | 3/1965 | France | 200/342 |
| 1349642 | 4/1974 | United Kingdom | 379/427 |

*Primary Examiner*—Henry J. Recla
*Assistant Examiner*—Glenn T. Barrett
*Attorney, Agent, or Firm*—Darby & Darby

[57] ABSTRACT

The invention relates to a switch device which is suitable for use, for example, in a telephone to detect the presence of the handset (11) in the cradle (9). The switch device comprises a frame (3), a switch (4) movable in relation to the frame, and a separate plunger (2) acting on the switch, the plunger comprising a press knob (5) and a spring part (6). The plunger operates by bringing the switch (4) into the connecting position and by releasing it, after the pressure has ceased, to return to the initial position. It is essential in the invention that the spring part (6) of the plunger comprises a part which is against the switch (4) and is wider than the switch, is of a resilient material and hollow. This part (6) may be made up, for example, of a transverse sleeve or ring as an extension of the press knob (5). When the plunger has brought the switch (4) to the connecting position and the pressure continues, the spring part will receive the pressure by bearing on the frame of the device on the different sides of the switch and by yielding at the same time by flattening.

7 Claims, 2 Drawing Sheets

SWITCH DEVICE

BACKGROUND OF THE INVENTION

The present invention relates to a switch device which comprises a frame; an electric switch which is installed in the frame and can be pressed into a connecting position and will return to an initial position when the pressure ceases; and a switch-actuating plunger which is made up of a pressing knob and a spring part. Upon being pressed, plunger brings the switch into the connecting position and, upon the termination of the pressure, allows it to return to the initial position.

The applications of the invention include electrically operating apparatuses which comprise a peripheral device, wherein the operating state of the electric system depends on the peripheral device being in place. In order to operate, such apparatuses require a switch device equipped with a plunger which the peripheral device presses upon when in place and which is released and returns to its initial position immediately when the peripheral device is lifted off. One example of the said apparatuses is the telephone, in which the cradle of the handset may be equipped with a plunger acting on a moving switch. The handset, when on the cradle, presses this plunger, thus keeping the switch in the connecting position. When the handset is lifted the plunger is released and at the same time releases the switch into its initial position. These functions of the switch device pressed by the handset are necessary for the appropriate operation of the telephone.

A moving switch may be equipped with a separate, spring-loaded plunger when it is desired to prevent the pressing force from acting as such directly on the switch. The switch may be prone to damage or wear, in which case the plunger protects it receiving a portion of the pressing force and by attenuating the impact caused by it and aimed at the switch. On the other hand, it is possible that the presence of the plunger in the switch construction is purely a question of design and dimensioning. The actual switch may be located so that it is impossible to press it directly, in which case a separate plunger is necessary for directing an impulse to the switch from pressure applied elsewhere.

In one prior-art switch system used in telephones, the plunger with its pressing knob is fitted in an opening in the cradle of the handset and is connected by means of a lever spring to a microswitch under the cradle. The end of the lever spring is, in this case, articulated to the switch frame and is arranged to press a moving switch part connected to the frame. This system has, however, the drawback that the lever spring is unreliable in operation and thus is insufficient when acting alone. Therefore, it has been necessary to provide as an aid for it an additional spring, for example located in parallel with the pressing knob, directly under the plunger. However, the additional spring makes the construction more complicated and more space-consuming.

SUMMARY OF THE INVENTION

The object of the present invention is to form a switch device which is simpler and more reliable in operation than the above-mentioned prior-art switch system and in which the need for a separate additional spring connected to the plunger is avoided. It is characteristic of the device according to the invention that the spring part of the plunger is made up of a part which is against the switch, wider than the switch and is of a resilient material and hollow. Upon the switch having been pressed into the connecting position, the spring part will bear on the frame of the apparatus on the different sides of the switch and, as the pressure continues, will yield in the middle by flattening.

It is essential in the invention that the spring constitutes part of the plunger and is integral with its other parts, whereby the fastening of the spring to the switch frame in accordance with the prior-art system is avoided. Fewer separate parts are thus needed, and the assembly of the switch device will be less expensive than previously. The spring part of the plunger effectively receives any excess pressing force so that even forceful pressing of the knob will not strain the switch. In addition the equalizing effect of the spring part on the operation of the device means that the dimensioning tolerances of the plunger can be slacker than previously.

The plunger spring part according to the invention, which is capable of flattening in the middle, may be shaped like a ring or a sleeve. The spring part may, for example, be made up of a flat ring part at the end of the press knob, parallel to the direction of movement of the knob. The plungers suitable for the invention can advantageously be made of plastic by injection molding. In this case the plungers will not require after-treatment and will be economical to manufacture. It is, however, possible to manufacture the knob and spring part of the plunger separately and thereafter attach them to each other to form one continuous piece.

The device according to the invention is suitable for being installed on a wall which has an opening for the reciprocatingly moving knob of the plunger. In which case, the pressure will be from the wall side opposite in relation to the switch. In this case the opening will serve as a guide for the press knob, and when the opening is sufficiently narrow the wall will form an effective limiter for the pressing of the knob.

An important application of the invention is in telephones, in which the switch device is installed in accordance with what is described above. In these, the wall is made up of the handset cradle, the handset presses the press knob which is fitted in a hole in the cradle and thus holds the moving microswitch under the cradle in its connecting position.

BRIEF DESCRIPTION OF THE DRAWINGS

The invention is described below in greater detail with the help of an example and with reference to the accompanying drawings, in which.

DESCRIPTION OF THE PREFERRED EMBODIMENT

Figure 1:
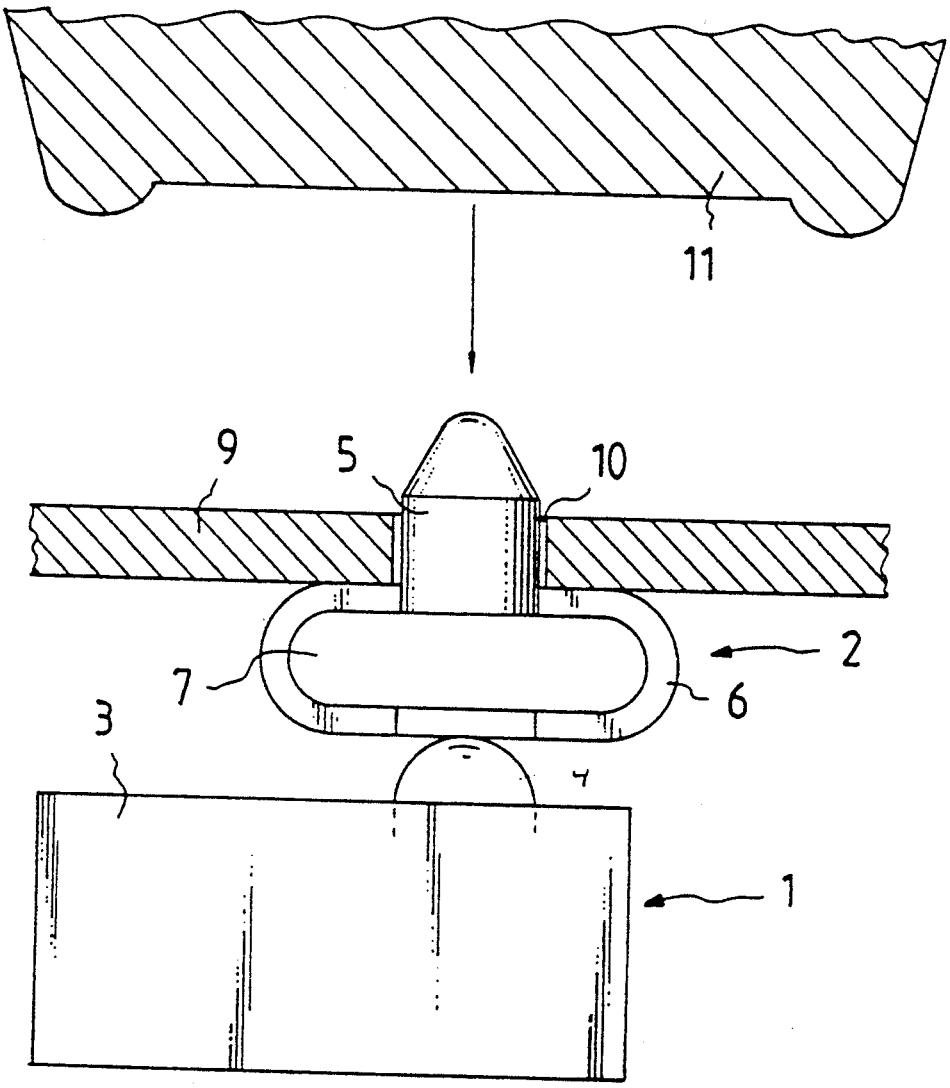
FIG. 1 depicts one switch device according to the invention, as a part of a telephone, the handset being out of the cradle and the moving switch and plunger of the device being in the initial position.
Figure 2:
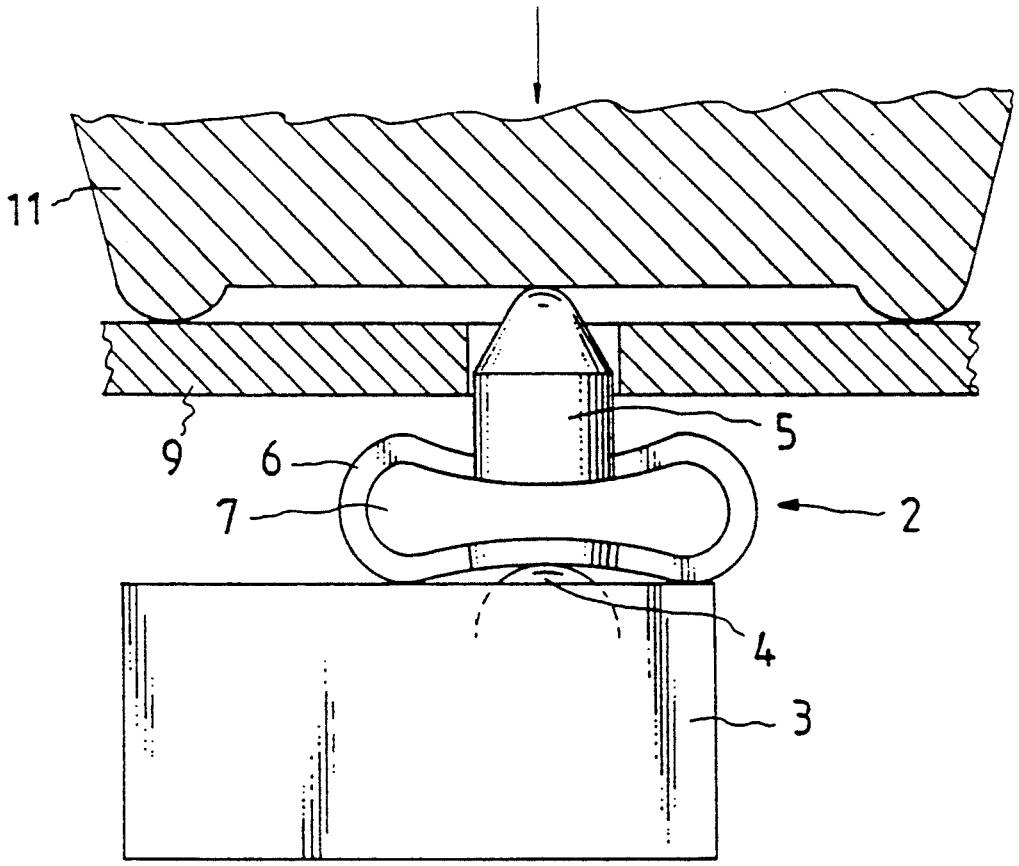
FIG. 2 depicts the switch device according to FIG. 1, with the handset in the cradle and holding the switch and the plunger pressed in the connecting position.
Figure 3:
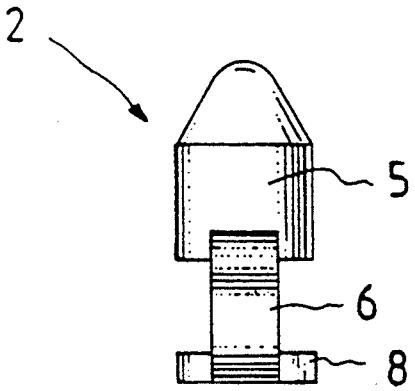
FIGS. 3 and 4 depict side and front views of the plunger, separate.
Figure 4:
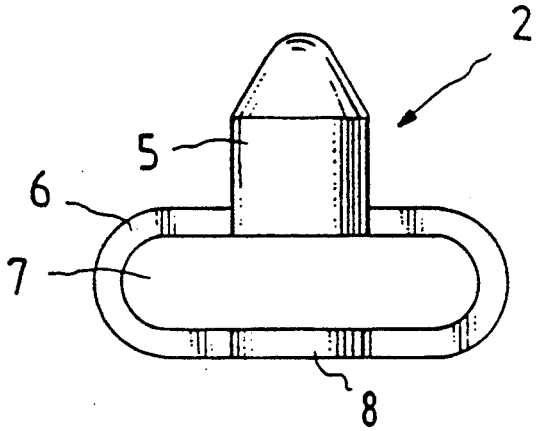

The switch device according to FIGS. 1 and 2, which belongs to telephone, comprises a microswitch 1 and a spring-loaded plunger 2 acting on it. The microswitch 1 comprises a frame 3 and a switch actuation 4 movable in relation to the frame, the switch in FIG. 1 being free in its initial position and in FIG. 2 being pressed into the connecting position. The switch actuation 4 may be equipped, for example, with a spring (not depicted) for returning the switch from the connecting position to the initial position after the force on it has ceased. The plunger 2, located on top of the moving switch actuator 4 and moving in the same direction as it, comprises a press knob 5 and, as its direct extension, a spring part 6 acting on the switch actuation 4. The spring part 6 is ring made up of a rather short, flat, sleeve-like part (cf. FIGS. 3 and 4). The axis of its opening 7 is perpendicular to the direction of movement of the press knob 5 and the switch 4. The spring part 6 has a widened portion 8 located against the moving switch actuator 4, best visible in FIG. 3.

According to FIGS. 1 and 2, the switch device is installed as part of a telephone so that the knob 5 of the plunger is located in an opening 10 in the handset cradle 9, and the microswitch 1 is under the cradle. When the handset 11 is, in accordance with FIG. 1, off the cradle, the moving switch 4 and the plunger 2 are free in their initial positions. When the handset 11 is returned into the cradle 9, it first presses the switch 4 to the connecting position by means of the plunger 2, at which stage the plunger does not deform substantially. However, as the movement of the press knob 5 continues further, the spring part 6 of the plunger begins to receive the pressing force by bearing on the frame 3 of the microswitch on both sides of the switch 4 and by flattening in its middle, as shown in FIG. 2. FIG. 2 depicts a situation in which the handset 11 is resting in the cradle and the deformation of the spring part 6 of the plunger is at its greatest. When the handset 11 is lifted, the plunger 2 immediately straightens and shifts to its initial position, shown in FIG. 1, lifted by the spring of the switch 4.

For an expert in the art it is clear that the various embodiments of the invention are not limited to the example presented but may vary within the scope of the accompanying claims.

We claim:

1. A switch device adapted for mounting on a wall comprising:

a switch with a frame and a switch actuator projecting from said frame, said actuator being movable from an initial position to a connecting position upon applying pressure thereto, and from the connecting position to the initial position upon release of the pressure; and a plunger acting on said switch actuator and having a press knob and a hollow spring member formed of a resilient material, said hollow spring member having a base in contact with said switch actuator and having a width substantially greater than the width of said switch actuator, said hollow spring member acting on said switch-actuator upon application of pressure to said press knob to move said switch actuator from its initial position to its connecting position, said hollow spring member moving said switch actuator to the connecting position without being substantially deformed, upon further application of pressure to said pressure knob, said spring member engaging said frame on opposite sides of said switch actuator and yielding to pressure by being deformed at a location where said switch actuator engages said hollow spring member.

2. A switch device according to claim 1, wherein the spring member of the plunger is ring-like in configuration.

3. A switch device according to claim 2, wherein the spring member comprises a flat ring part located on an end of the press knob and extending transverse to a direction of movement of the knob.

4. A switch device according to claim 3, wherein the plunger is formed of injection-molded plastic.

5. A switch device according to claim 1, wherein the spring member of the plunger is sleeve-like in configuration.

6. A switch device according to claim 1, wherein said switch device is mounted on a wall having inner and outer surfaces, and an opening therethrough, said frame is located behind the inner surface in spaced relation thereto, and the plunger extends through the opening in the wall, and said press knob is depressible from the outer surface of the wall, said press knob having an end projecting out of the outer surface of the wall and an opposite end, said spring member comprising a flat ring part located at said opposite end and extending transverse to a direction of movement of said press knob.

7. A switch device according to claim 6, wherein the device, is part of a telephone in which the wall constitutes a cradle for a handset, the handset on the cradle being arranged to press the press knob and thus to keep the switch actuator in the connecting position.

* * * * *